US006119810A

United States Patent [19]

Harder

[11] Patent Number: 6,119,810

[45] Date of Patent: Sep. 19, 2000

[54] FOLDABLE SCAFFOLD

[76] Inventor: Willard J. Harder, 2184 Van Sloan Rd., Chaska, Minn. 55318

[21] Appl. No.: 08/871,410

[22] Filed: Jun. 9, 1997

[51] Int. Cl.[7] ..... E04G 1/34; E04G 7/00; E06C 1/00

[52] U.S. Cl. ..... 182/152; 182/178.5

[58] Field of Search ..... 182/152–155, 182/178.5, 222, 178.6; 248/408, 419; 403/109.3

[56] References Cited

U.S. PATENT DOCUMENTS

| | | | |
|---|---|---|---|
| 1,043,172 | 11/1912 | Trew | 182/178.4 |
| 2,599,670 | 6/1952 | Thomas . | |
| 2,852,145 | 9/1958 | Scholz | 182/152 |
| 2,994,402 | 8/1961 | Tyler . | |
| 3,105,572 | 10/1963 | Nesslinger et al. . | |
| 3,498,412 | 3/1970 | Best | 182/152 |
| 4,534,447 | 8/1985 | Champigny . | |
| 4,609,071 | 9/1986 | Edwards | 182/152 |
| 4,891,926 | 1/1990 | Allenbaugh | 182/178.5 X |
| 5,086,875 | 2/1992 | Shreve, III . | |
| 5,099,953 | 3/1992 | Stegath . | |
| 5,259,690 | 11/1993 | Legge | 403/385 |
| 5,400,870 | 3/1995 | Inoue | 182/178.6 |
| 5,555,954 | 9/1996 | Swiderski | 182/152 |
| 5,702,198 | 12/1997 | Kuo | 403/109.3 |

*Primary Examiner*—Daniel P. Stodola
*Assistant Examiner*—Hugh B. Thompson

[57] ABSTRACT

A scaffold has a rigid main frame with cross members secured to each other to prevent all pivoting and angular movement of the members relative to each other and end frames pivotally mounted on the main frame with sleeves for movements between folded positions adjacent opposite sides of the main frame and open positions generally normal to the main frame. Releasable locks retain the end frames in the open positions. Supports for a person and objects extend between and are mounted on the end frames when the end frames are in the open positions.

13 Claims, 9 Drawing Sheets

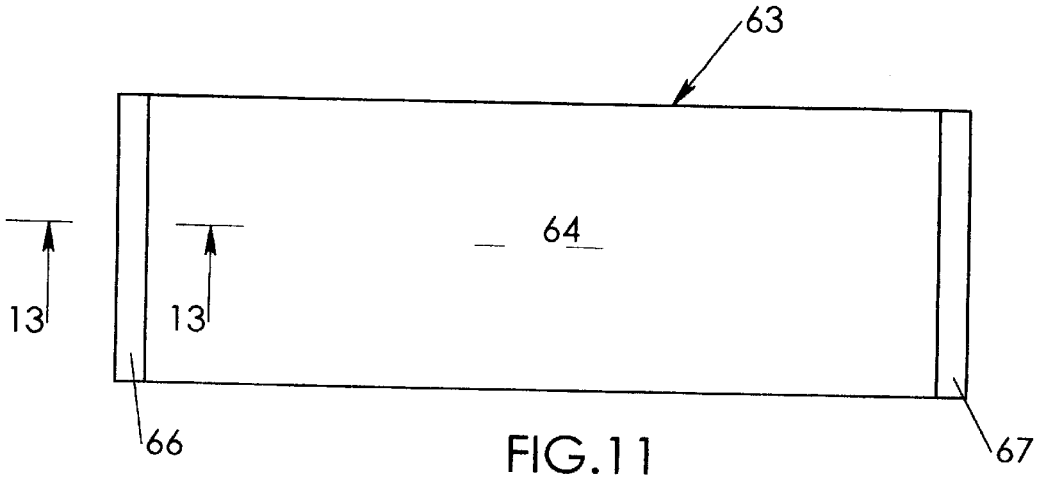
FIG.11
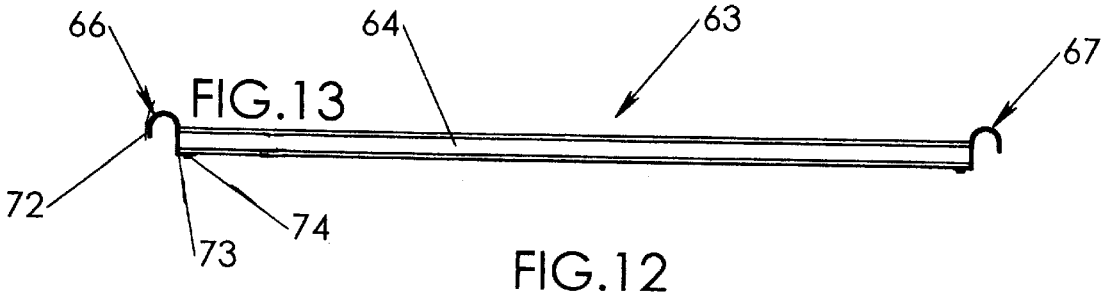
FIG.13
FIG.12
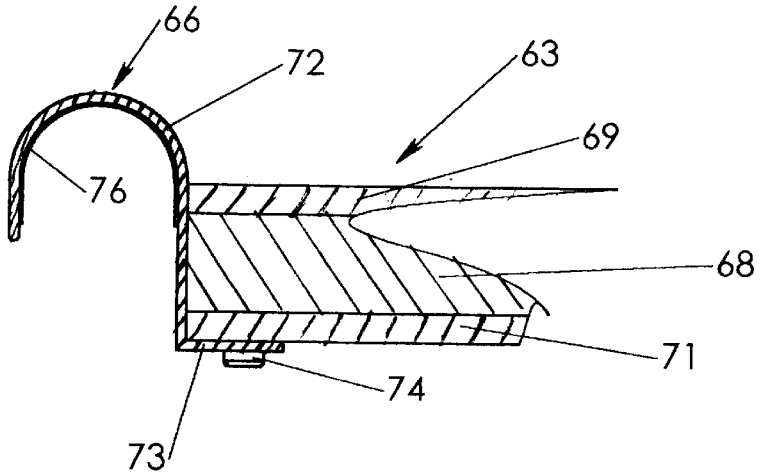
FIG.13

FOLDABLE SCAFFOLD

FIELD OF THE INVENTION

The invention relates to the art of step and platform scaffolds that can be folded into a narrow configuration to facilitate its transportation and storage.

BACKGROUND OF THE INVENTION

Foldable and portable scaffolds for support steps or platforms are known in the art. For example, G. G. Thomas in U.S. Pat. No. 2,599,670 shows a scaffold having end members with upright posts and transverse horizontal bars. A back member is pivoted to a post of each end member to allow the scaffold to be folded.

SUMMARY OF INVENTION

The scaffold of the invention is a support structure for steps, shelves, and platforms. The support is a foldable frame assembly having a back frame and end frames hinged to opposite ends of the back frame. The back frame has crossed bars that are fixed together at their mid-sections to provide the scaffold with lateral stability. The end frames have posts hinged to the back frame and horizontal step support members secured to posts. Releasable locks hold the end frames generally perpendicular to the back frame. A number of panels are hooked on the support members when the end frames are perpendicular to the back frame to provide steps, shelves or a platform. The end frames are foldable adjacent opposite sides of the back frame to reduce the width of the scaffold to facilitate its transport and storage. The locks are released to allow the end frames to be moved to the folded positions.

DESCRIPTION OF THE DRAWINGS

FIG. 11 is a top plan view of a support for the scaffold;

FIG. 12 is a front elevational view of FIG. 11;

FIG. 13 is an enlarged sectional view taken along line 13—13 of FIG. 11;

DESCRIPTION OF PREFERRED EMBODIMENT

The scaffold 10, shown in FIGS. 1 to 5, is a foldable frame used with supports, as a work bench, sawhorse and a platform for a workperson. The scaffold is portable for transport to a job site or a location requiring a workperson to be elevated. Transport and storage of the scaffold is convenient as the scaffold is foldable into a generally flat configuration.

Figure 1:
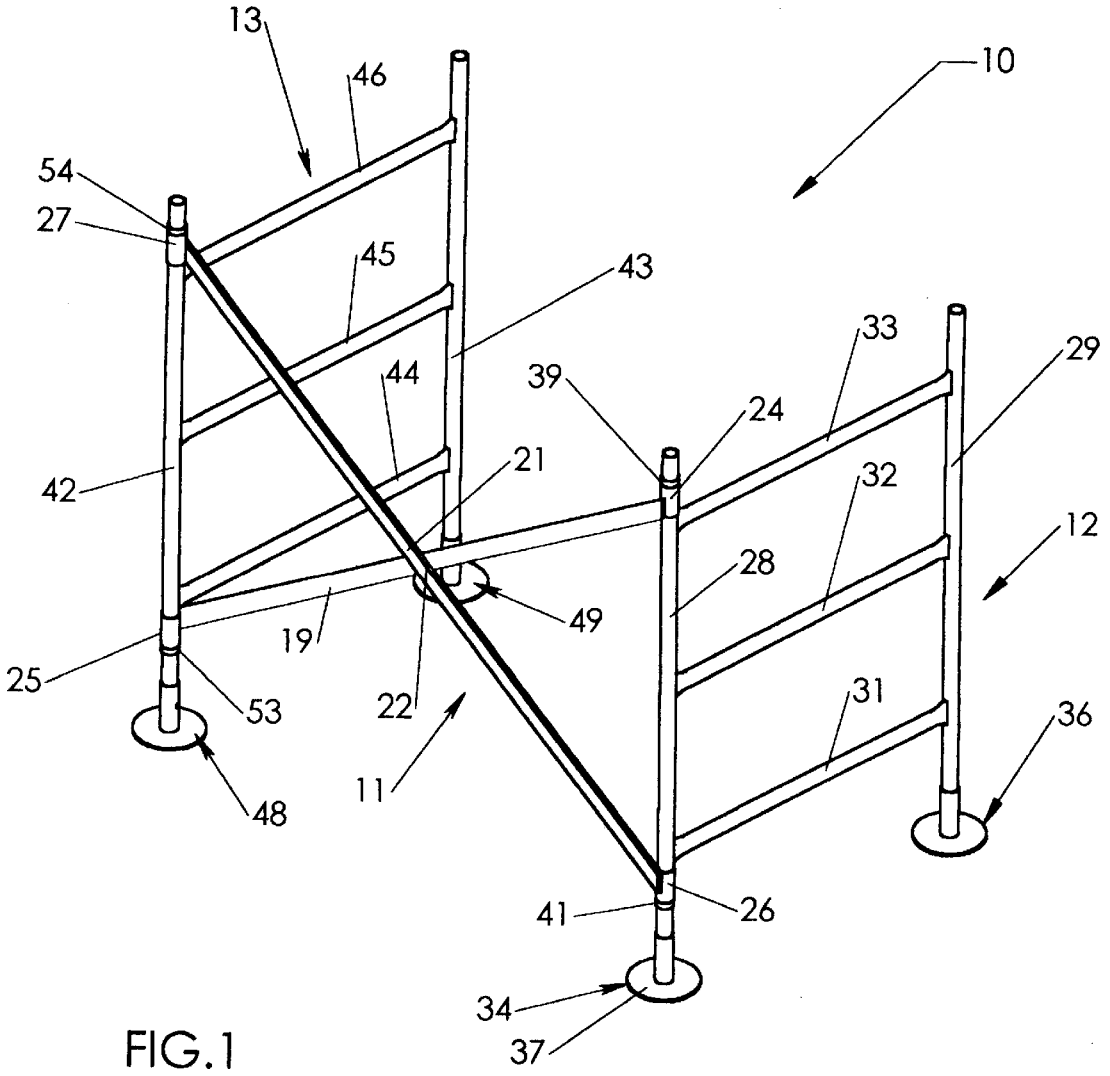
FIG. 1 is a perspective view of the foldable scaffold of the invention.
Figure 2:
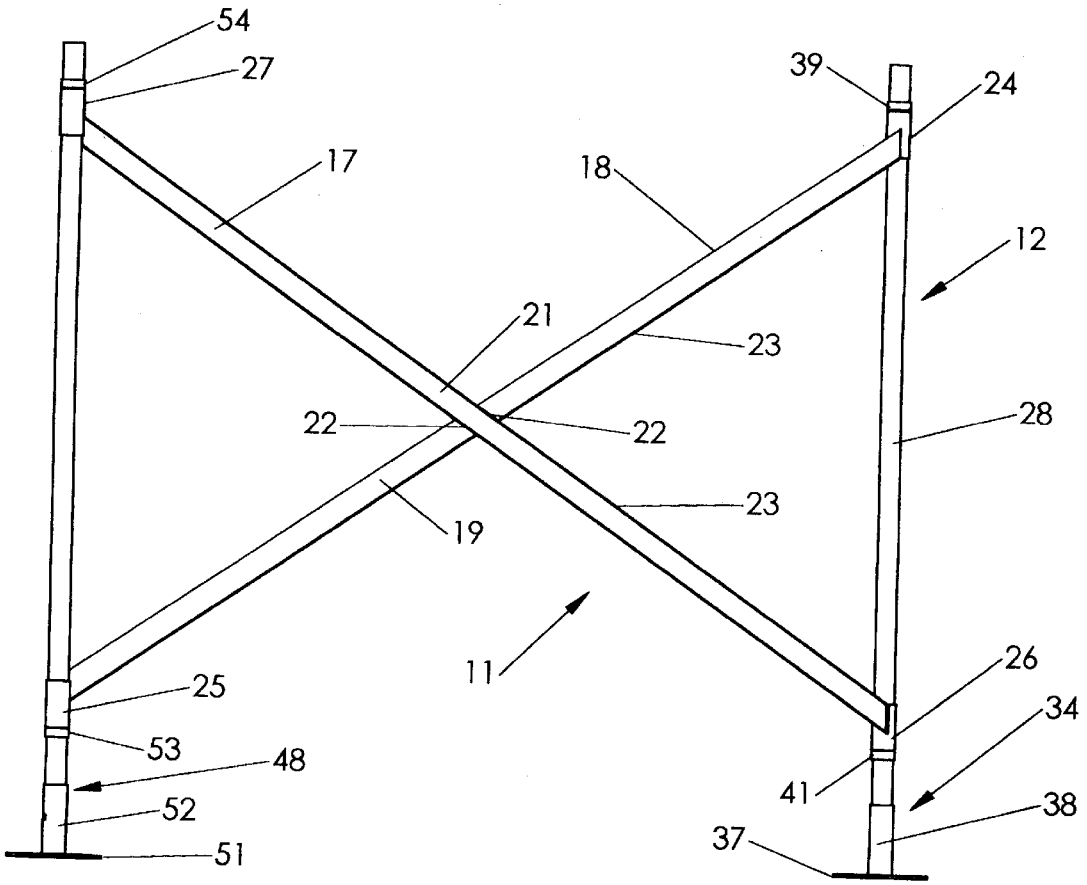
FIG. 2 is an enlarged elevational view of the back of the foldable scaffold of the invention.
Figure 3:
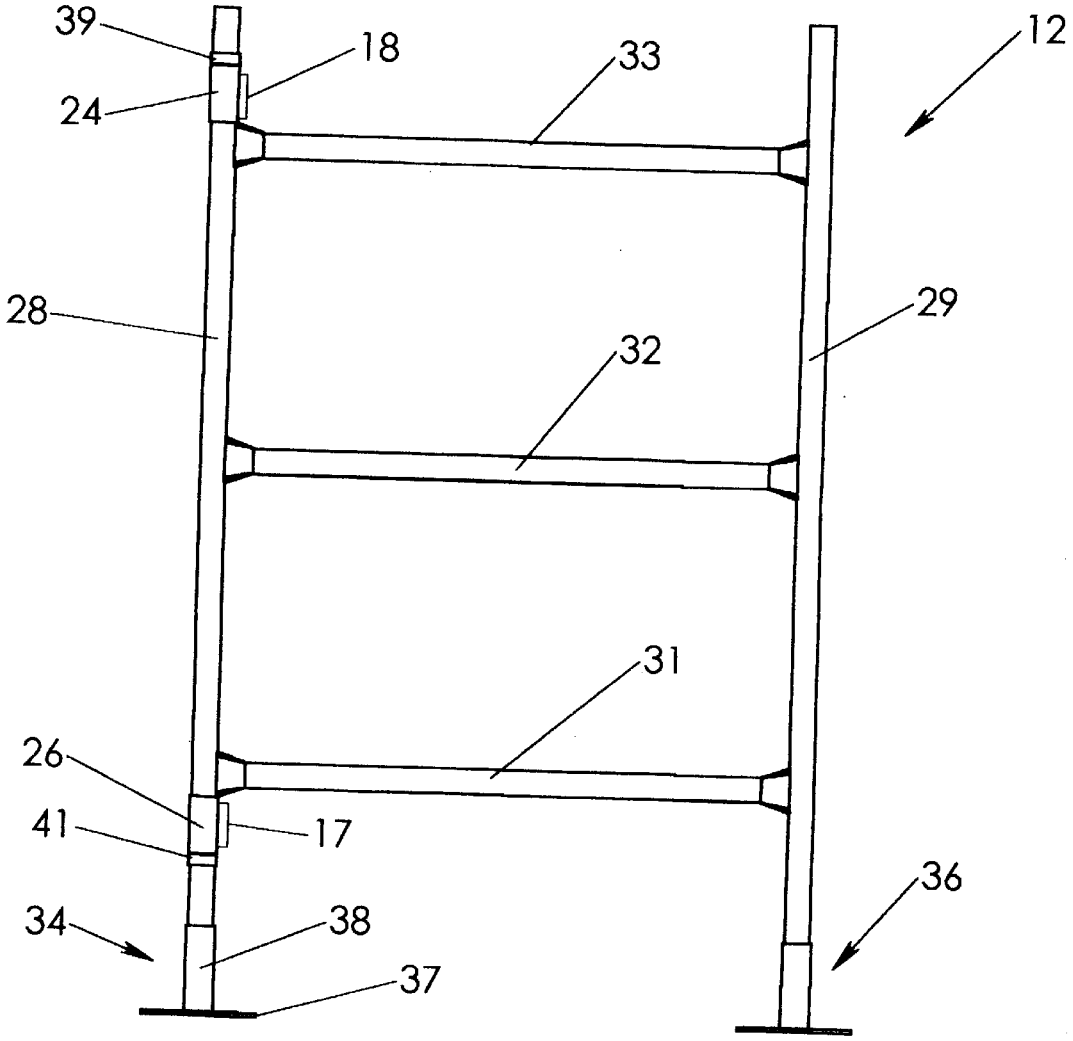
FIG. 3 is an elevational view of the end frame on the right side of FIG. 2.
Figure 4:
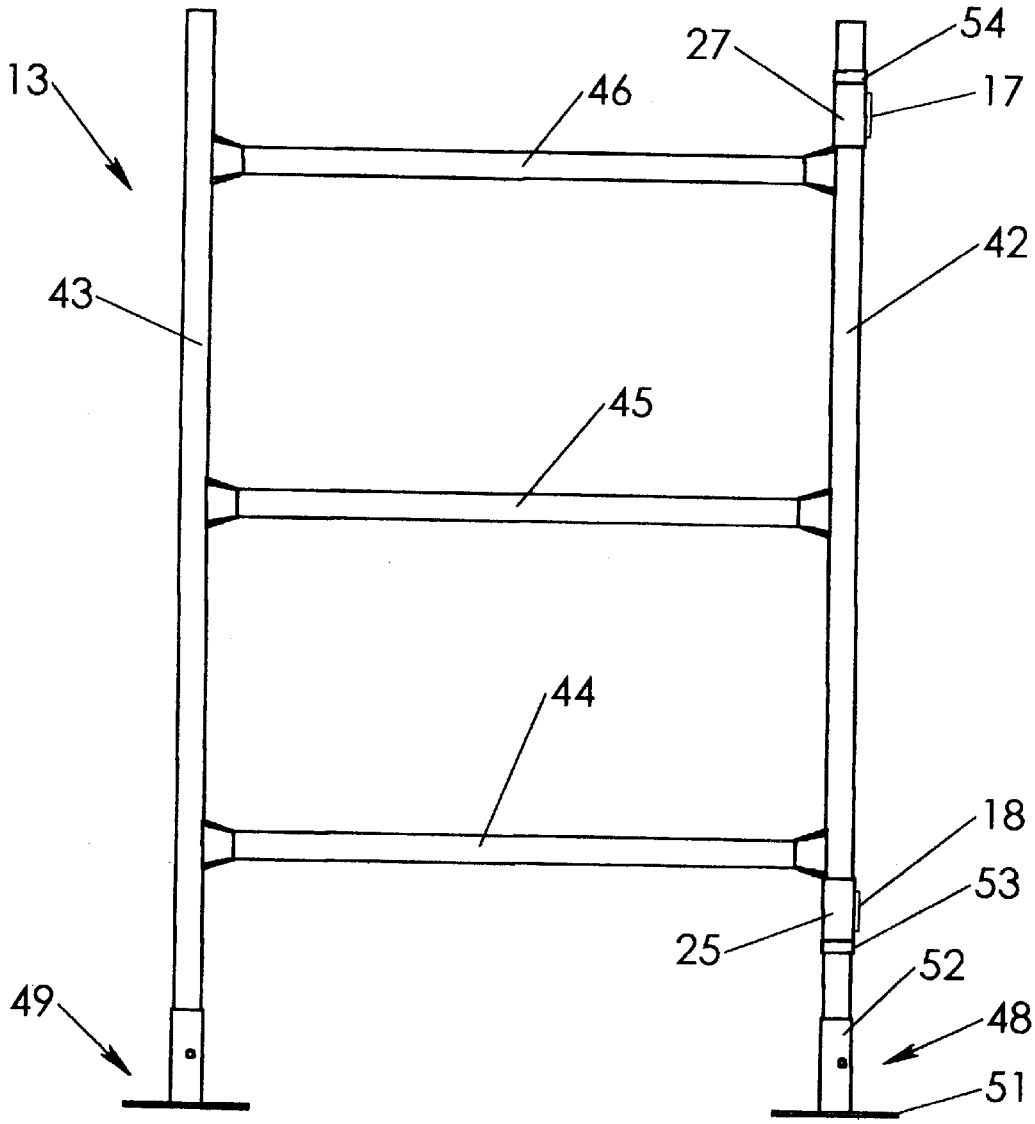
FIG. 4 is an elevational view of the end frame on the left side of FIG. 2.
Figure 5:
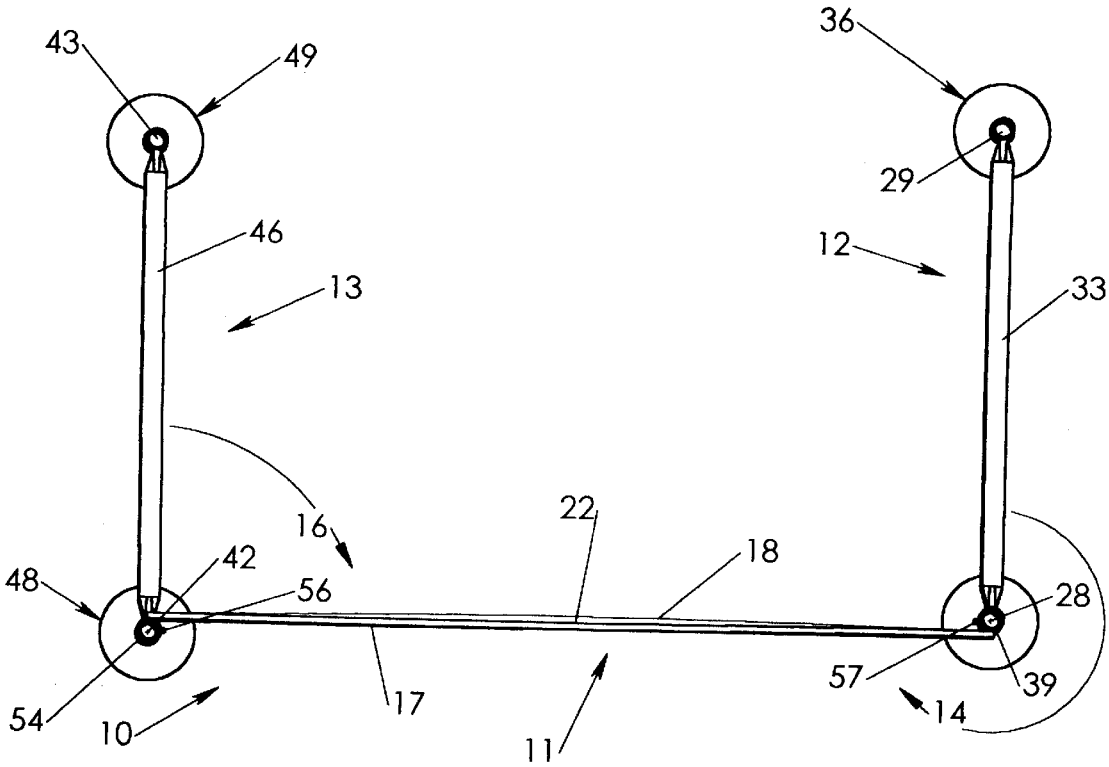
FIG. 5 is a top plan view of FIG. 2.
Figure 9:
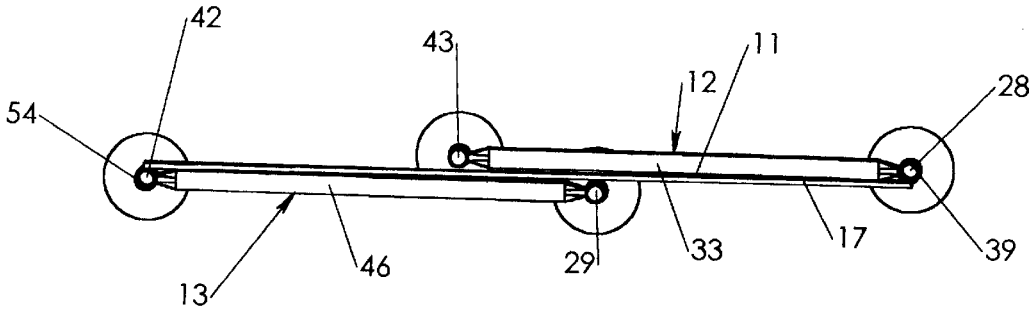
FIG. 9 is a top plan view showing the scaffold in the folded position.
Figure 10:
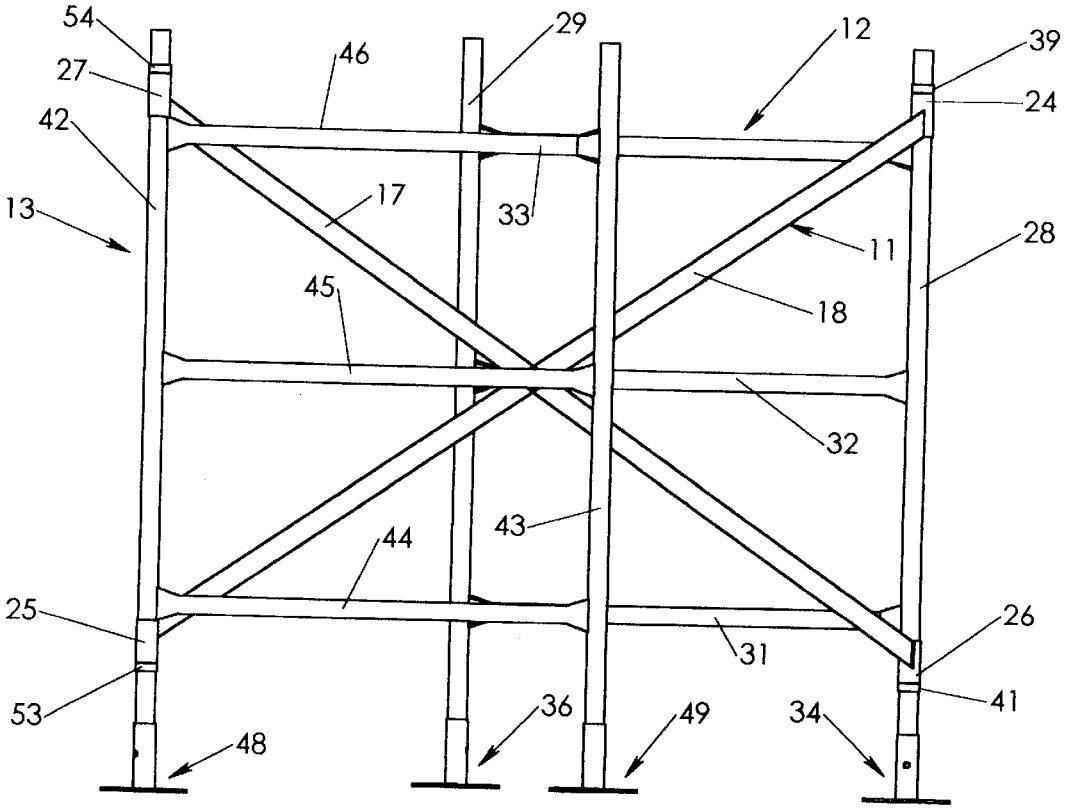
FIG. 10 is a front elevational view of FIG. 9.

Scaffold has a back or rear frame 11 articulately joined to end frames 12 and 13. End frames 12 and 13 are selectively movable from first positions generally normal to frame 11, as shown in FIGS. 1 and 5, to second positions wherein frames 12 and 13 are located adjacent opposite sides of frame 11, as shown in FIGS. 9 and 10. End frame 12 turns about an upright axis in the direction of arrow 14, shown in FIG. 5, to its folded position adjacent frame 11. End frame 13 folds forward in the direction of arrow 16 to its folded position adjacent frame 11. End frames 12 and 13 when in their folded positions are adjacent opposite sides of frame 11.

Frame 11 comprises opposite diagonal arms or bars 17 and 18 having middle sections 19 and 21 that cross each other. Bars 17 and 18 are rigid metal members. Sections 19 and 21 are secured together with welds 22 to fix the angular relationship of bars 17 and 18 relative to each other. Bars 17 and 18 are angularly disposed about 75 degrees as shown by arrow 23 in FIG. 2. Other angular relationships between arms 17 and 18 can be used in frame 11. Welds 22 prohibit pivoting or angular relative movement of arms 17 and 18. Upright tubular members or sleeves 24, 25, 26 and 27 are secured with welds to the outer ends of bars 17 and 18. As shown in FIGS. 1 and 5, the upper end of bar 17 is secured to the outside of sleeve 27 and the lower end of bar 17 is secured to the inside of sleeve 26. The upper end of bar 18 is secured to the inside of sleeve 24 and the lower end of bar 18 is secured to the outside of sleeve 25.

First end frame 12 has a pair of upright posts 28 and 29 connected with vertically spaced horizontal cross members 31, 32 and 33. Opposite ends of members 31, 32 and 33 are secured with welds to posts 28 and 29. Posts 28 and 29 and cross members 31–33 are rigid tubular metal members. Posts 28 and 29 and cross members 31–33 can be solid rigid rods. The lower ends of posts 28 and 29 are attached to pad members 34 and 36. Each pad member 34, 36 is a foot having a circular base 37 joined to an upright tube 38. The lower ends of post 28 and 29 telescope into tubes 38 and are secured thereto.

Post 28 extends through sleeves 24 and 26 thereby rotatably coupling frame 12 to frame 11 for movement about an upright axis between its normal and folded positions. Sleeve 24 is located in contact with cross member 33 and retained in position on post 28 with a collar 39 secured to post 28. Sleeve 26 contacts cross member 31. A collar 41 maintains the position of sleeve 26 on post 28. Collars 39 and 41 and cross members 31 and 33 inhibit bars 17 and 18 from spreading and bending.

Second end frame 13 has a pair of upright posts 42 and 43 connected with horizontal cross members 44, 45 and 46. Posts 42 and 43 and members 44–46 are rigid metal tubes that are welded together. The lower ends of posts 42 and 43 are attached to pad members 48 and 49. Each pad member 48, 49 is a foot having a circular base 51 secured to an upright tube 52. The lower ends of posts 42 and 43 telescope into tubes 52 and are secured thereto.

Post 42 extends through sleeves 25 and 27 to rotatably connect frame 13 to frame 11 for movement about an upright axis between its normal and folded positions. Sleeve 25 is in contact with cross member 44. A collar 53 secured to post 42 retains sleeve 25 in position on post 42. Top sleeve 27 contacts cross member 46. A collar 54 surrounds post 42 adjacent the top of sleeve 27 to retain sleeve 27 on post 42. Collars 53 and 54 and cross members 44 and 46 inhibit spreading and bending of bars 17 and 18.

Figure 6:
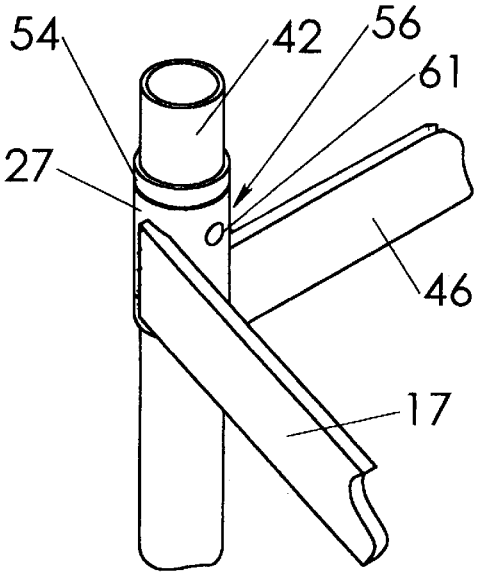
FIG. 6 is a perspective view of a top corner of the foldable scaffold.
Figure 7:
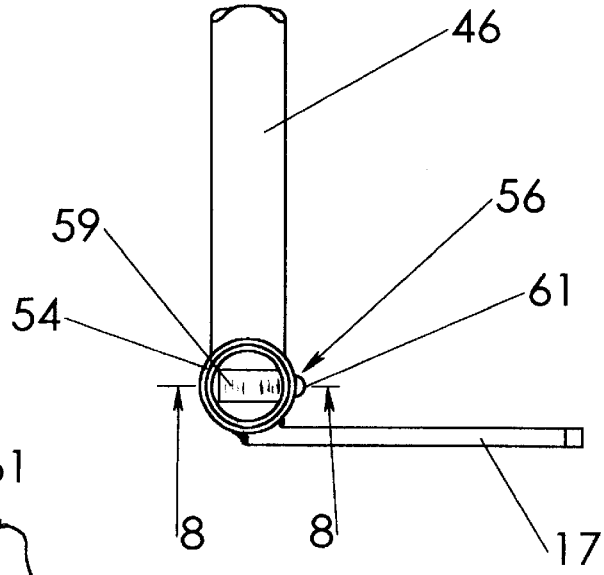
FIG. 7 is a top plan view of FIG. 6.
Figure 8:
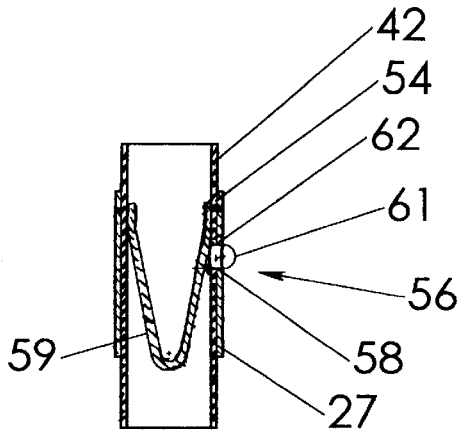
FIG. 8 is an enlarged sectional view taken along line 8—8 of FIG. 7.

Releasable locks 56 and 57 cooperate with posts 28 and 42 and sleeves 24 and 27 to hold frames 12 and 13 in their normal positions. As shown in FIGS. 1 and 5, end frames 12 and 13 are located in vertical planes that are about 90 degrees from the vertical plane of frame 11. Releasable locks 56 and 57 are identical. FIGS. 6 to 8 show lock 56. Sleeve 27 has a side hole 58. A U-shaped spring 59 located within post 42 has a projection or button 61 extended through a hole 62 in post 42 and hole 58. when projection 61 is in holes 58 and 62 post 42 is locked onto sleeve 27 which prevents pivoting of frame 13 relative to frame 11. Lock 56 retains frame 13 in its normal position. Projection 61 must be pushed into post 42 past hole 58 to release frame 13 from sleeve 27 to allow frame 13 to be moved to its folded position.

Figure 14:
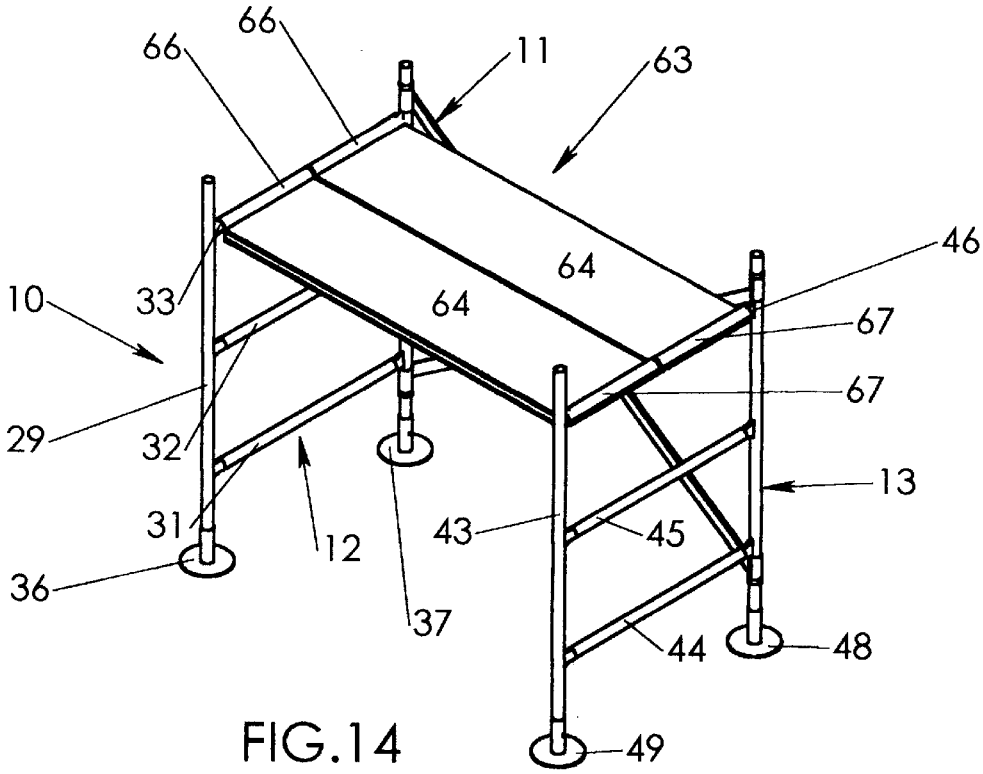
FIG. 14 is a perspective view of the foldable scaffold accommodating supports arranged as a table or work bench.
Figure 15:
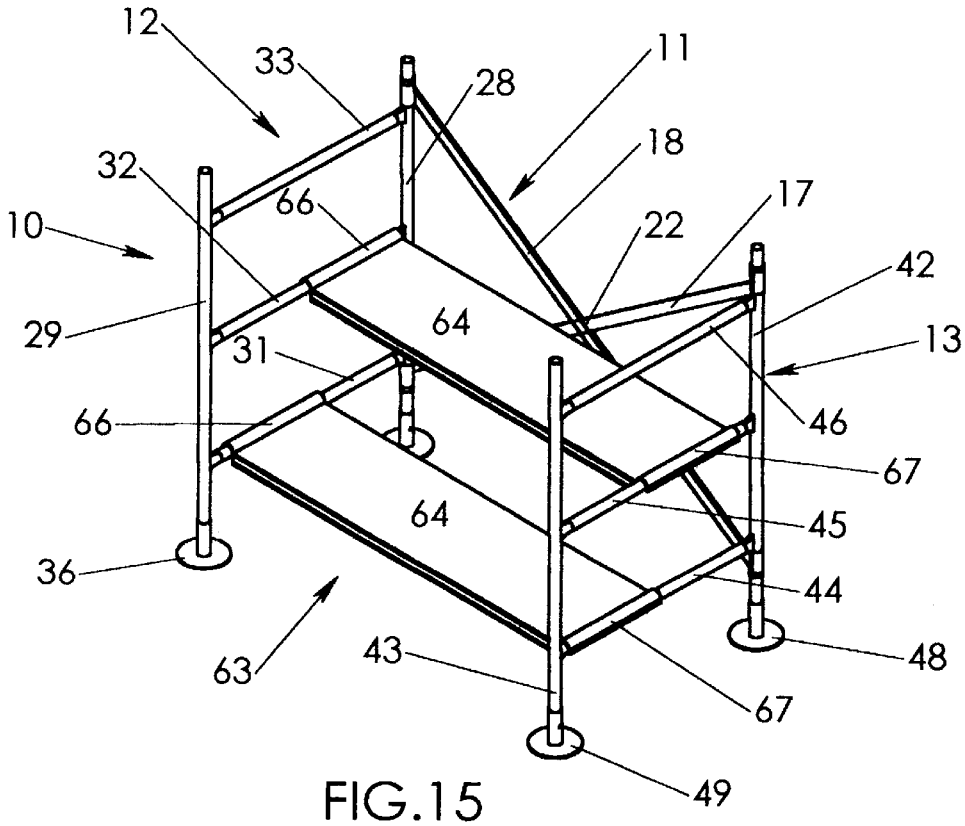
FIG. 15 is a perspective view of the foldable scaffold accommodating supports arranged as steps.

A support member or step 63, shown in FIGS. 11, 12 and 13, is mounted on selected cross members 31–33 and 44–46 to provide a work bench, sawhorse or steps for workpersons. Support member 63 has a generally rectangular panel 64 and hooks 66 and 67 secured to opposite ends of panel 64. Hooks 66 and 67 fit over selected cross members 31–33 and 44–46 when frames 12 and 13 are in their normal positions, as shown in FIGS. 14 and 15. Panel 64 has a solid core 68, such as a board or plank of wood. Sheets 69 and 71 of wood are laminated to opposite sides of core 68 to increase bending strength and minimize bending and workage of core 68. Hooks 66 and 67 are identical metal extrusions. FIG. 13 shows hooks 66 comprising an inverted U-shaped section 72 joined to an inwardly directed lip 73. The end of panel 63 rests on lip 73. A plurality of screws 74 secures panel 63 to lip 73. A strip of high friction material 76 is secured to the inside surface of the inverted U-shaped section 72 to provide a tight friction grip on the cross member located within the hook. High friction material 76 is an adhesive tape secured to U-shaped section 72. Other types of friction materials can be used to enhance the grip of hook 66 on the cross member supporting the panel.

Scaffold 10, shown in FIG. 14, holds a pair of supports or panels 64 on the top cross members 33 and 46 of frames 12 and 13 to provide a table, work bench or sawhorse for the workperson. Additional panels can be located below panels 64 and supported on cross members 32, 45 and 31, 44 to provide shelves.

Scaffold 10, shown in FIG. 15, holds supports or panels 64 on adjacent cross members 31, 44 and 32, 45 to provide steps and platforms at different elevations.

The folding scaffold of the invention has been illustrated and described as a preferred embodiment. Modifications in structure, arrangement of structures, and materials may be made without departing from the invention. The invention is defined in the following claims.

What is claimed is:

1. A scaffold comprising: a frame assembly having a first back frame, a first end frame and a second end frame foldable from a U-shape arrangement to a generally flat configuration, said first frame having a pair of rigid members, said members having opposite ends and middle portions that cross each other, means permanently securing the middle portions to each other to fix the angular relationship of the members relative to each other and prevent all pivoting and angular movement of the members relative to each other, first sleeves secured to one of the ends of the members, second sleeves secured to the other ends of the members, said first end frame having a pair of upright first posts, each first post having an upper end and a lower end, horizontal first cross members secured to the first posts between the upper and lower ends thereof, adjacent first cross members being vertically spaced from each other, one of said upright first posts having upper and lower end portions extended through said first sleeves whereby the first end frame is rotatably mounted on the first sleeves for selective movement from a first position generally normal to the first frame to a second position adjacent one side of the first frame, said second end frame having a pair of upright second posts, each second post having an upper end and a lower end, horizontal second cross members secured to the second posts between the upper and lower ends thereof, adjacent second cross members being vertically spaced from each other, one of said second posts having upper and lower end portions extended through the second sleeves whereby the second end frame is rotatably mounted on the second sleeves for selective movement from a first position generally normal to the first frame and generally parallel to the first end frame and a second position adjacent the other side of the first frame, a stationary pad member secured to the lower ends of the first and second upright posts for supporting the scaffold on a support surface, a first lock means cooperating with one of the first sleeves and the one of said upright first posts for holding the first end frame generally normal to the first frame, said first lock means being releasable to allow the first end frame to be moved to the second position adjacent one side of the first frame, a second lock means cooperating with one of the second sleeves and the one of said upright second posts for holding the second end frame generally normal to the first frame, said second lock means being releasable to allow the second end frame to be moved to the second position adjacent the other side of the first frame and support means for accommodating a person and objects extended between and mounted on the first and second cross members when the first and second end frames are in the first positions, said support means including a generally flat horizontal support having opposite ends, and inverted U-shaped hooks secured to the opposite ends of the support and located around the first and second cross members, each hook having a first downwardly extended portion located adjacent one side of a cross member and second downwardly extended portion located adjacent the side opposite the one side of the cross member to retain the support means on the first and second end frames, said hooks cooperating with the first and second lock means to hold the first and second end frames in the first positions.

2. The scaffold of claim 1 wherein: each lock means includes aligned holes in the post and sleeves associated with the lock means, a projection extended through said holes, and biasing means releasably holding the projection in said holes, said biasing means allowing the projection to be moved out of the hole in the sleeves whereby the end frame can be rotated relative to the sleeve means from the first position to the second position.

3. The scaffold of claim 1 wherein: the first sleeves comprises an upper sleeve secured to one end of one rigid member and a lower sleeve secured to one end of the other rigid member, said upper and lower sleeves being vertically aligned to accommodate the one of said upright first posts, the second sleeves comprising an upper sleeve secured to the other end of the other rigid member, and a lower sleeve secured to the other end of the one rigid member, said sleeves of the second sleeve means being aligned to accommodate the one of said upright second posts.

4. The scaffold of claim 1 including: collars mounted on the one of the first and second posts engageable with the first and second sleeves.

5. The scaffold of claim 1 wherein: each hook has a horizontal lip for supporting an end of the support.

6. The scaffold of claim 1 including: high friction material secured to the inside of each inverted U-shaped hook to enhance the grip of an U-shaped hook on the cross member accommodating the inverted U-shaped hook.

7. A scaffold comprising: a frame assembly having a first back frame, a first end frame and a second end frame foldable from a U-shape arrangement to a generally flat configuration, said first frame having a pair of rigid members, said members having opposite ends and middle portions that cross each other, means securing the middle portions to each other to fix the angular relationship of the members relative to each other and prevent all pivoting and angular movement of the members relative to each other whereby the members are always located in same positions relative to each other, first sleeves secured to one of the ends of the members, second sleeves secured to one of the ends of the members, said first end frame having a pair of upright first posts, each first post having an upper end and a lower end, horizontal first cross members secured to the first posts between the upper and lower ends thereof, adjacent first cross members being vertically spaced from each other, one of said upright first posts having portions extended through said first sleeves whereby the first end frame is rotatably mounted on the first sleeves for selective movement from a first position generally normal to the first frame to a second position adjacent one side of the first frame, said second end frame having a pair of upright second posts, each second post having an upper end and a lower end, horizontal second cross members secured to the second posts between the upper and lower ends thereof, adjacent second cross members being vertically spaced from each other, one of said second posts having portions extended through the second sleeves whereby the second end frame is rotatably mounted on the second sleeves for selective movement from a first position generally normal to the first frame and generally parallel to the first end frame and a second position adjacent the other side of the first frame, a stationary pad member secured to the lower ends of the first and second upright posts for supporting the scaffold on a support surface, a first lock means cooperating with one of the first sleeves and the one of said upright first posts for holding the first end frame generally normal to the first frame, said first lock means being releasable to allow the first end frame to be moved to the second position adjacent one side of the first frame, a second lock means cooperating with one of the second sleeves and the one of said upright second posts for holding the second end frame generally normal to the first frame, said second locking means being releasable to allow the second end frame to be moved to the second position adjacent the other side of the first frame, and support means for accommodating a person comprising a horizontal member extended between the first cross member and second cross member when the first and second end frames are in the first positions, and means secured to the horizontal member and mounted on the first and second cross members, said means secured to the horizontal member cooperating with the first and second lock means to retain the first and second end frames in the first positions.

8. The scaffold of claim 7 wherein: each lock means includes aligned holes in the post and sleeves associated with the lock means, a projection extended through said holes, and biasing means releasably holding the projection in said holes, said biasing means allowing the projection to be moved out of the hole in the sleeves whereby the end frame can be rotated relative to the sleeve means from the first position to the second position.

9. The scaffold of claim 7 wherein: the first sleeves comprises an upper sleeve secured to one end of one rigid member and a lower sleeve secured to one end of the other rigid member, said upper and lower sleeves being vertically aligned to accommodate the one of said upright first posts, the second sleeves comprising an upper sleeve secured to the other end of the other rigid member, and a lower sleeve secured to the other end of the one rigid member, said sleeves of the second sleeves being aligned to accommodate the one of said upright second posts.

10. The scaffold of claim 7 including: collars mounted on the one of the first and second posts engageable with the first and second sleeve means.

11. A scaffold comprising: a frame assembly having a first back frame, a first end frame and a second frame foldable from a U-shape arrangement to a generally flat configuration, said first frame having a pair of rigid members, said members having opposite ends and portions that engage each other, means securing the portions to each other to prevent all pivoting and angular movement of the members relative to each other whereby the members are always located in same positions relative to each other, first sleeves secured to one of the ends of the members, second sleeves secured to the other ends of the members, said first end frame having a pair of upright first posts and horizontal first cross members secured to the first posts, one of said upright posts having portions extended through said first sleeves whereby the first end frame is rotatably mounted on the first sleeves for selective movement from a first position generally normal to the first frame to a second position adjacent the first frame, and a second end frame having a pair of upright second posts and horizontal second cross members secured to the second posts, one of said second posts having portions extended through the second sleeves whereby the second end frame is rotatably mounted on the second sleeves for selective movement from a first position generally normal to the first frame and generally parallel to the first end frame and a second position adjacent the first frame, said first and second posts having lower ends, stationary pad members secured to the lower ends of the first and second posts for supporting the scaffold on a support surface, a first lock means cooperating with one of the first sleeves and the one of said upright posts for holding the first end frame generally normal to the first frame, said first lock means being releasable to allow the first end frame to be moved to the second position adjacent one side of the first frame, and a second lock means cooperating with one of the second sleeves and the one of said upright second posts for holding the second end frame generally normal to the first frame, said second lock means being releasable to allow the second end frame to be moved to the second position adjacent the other side of the first frame, support means for accommodating a person extended between the first cross members and second cross members when the first and second end frames are in the first positions, and means secured to the support means and mounted on the first and second cross members, said means secured to the support means cooperating with the first and second lock means to retain the first and second end frames in the first positions.

12. The a scaffold of claim 11 wherein: each lock means includes aligned holes in the post and sleeves associated with the lock means, a projection extended through said holes, and biasing means releasably holding the projection in said holes, said biasing means allowing the projection to be moved out of the hole in the sleeves whereby the end frame can be rotated relative to the sleeves from the first position to the second position.

13. The scaffold of claim 11 wherein: the first sleeves comprises an upper sleeve secured to one end of one rigid member and a lower sleeve secured to one end of the other rigid member, said upper and lower sleeves being vertically aligned to accommodate the one of said upright first posts, the second sleeves comprising an upper sleeve secured to the other end of the other rigid member, and a lower sleeve secured to the other end of the one rigid member, said sleeves of the second sleeves being aligned to accommodate the one of said upright second posts.

* * * * *